United States Patent [19]

Mattson

[11] 4,259,652

[45] Mar. 31, 1981

[54] REVERSING RELAY FOR PERMANENT MAGNET DC MOTOR

[75] Inventor: Richard W. Mattson, Rossford, Ohio

[73] Assignee: Eltra Corporation, Toledo, Ohio

[21] Appl. No.: 34,108

[22] Filed: Apr. 30, 1979

[51] Int. Cl.[3] ..... H01H 50/54

[52] U.S. Cl. ..... 335/128; 335/133; 335/136

[58] Field of Search ..... 335/136, 135, 133, 181, 335/194, 200, 128, 120; 200/244, 245

[56] References Cited

U.S. PATENT DOCUMENTS

| | | | |
|---|---|---|---|
| 2,446,299 | 8/1948 | Nelsen | 335/120 |
| 2,564,246 | 8/1951 | Bourne | 335/181 |
| 2,587,948 | 3/1952 | Woolf | 335/136 |
| 3,001,049 | 9/1961 | Didier | 335/136 |
| 3,155,790 | 11/1964 | Lemonnier | 335/200 |
| 3,305,718 | 2/1967 | Waldron | 335/128 |
| 3,321,722 | 5/1967 | Cohen | 335/133 |
| 3,824,511 | 7/1974 | Aidn et al. | 335/133 |

*Primary Examiner*—Harold Broome

*Attorney, Agent, or Firm*—Joel I. Rosenblatt; James P. DeClercq

[57] ABSTRACT

A relay is provided for reversing the direction of current to an electric motor and providing for dynamic breaking when power is disconnected. The contacts are cantilevered from a pivoting support driven electromagnetically. Mounted inwardly of the cantilevered contacts, are a pair of cantilevered springs. Each cantilevered spring is adjacent to, and associated with, a respective cantilevered contact. When the relay is energized, displacing one of the cantilevered contacts, a respective cantilevered spring is deflected against the cantilevered contact to provide a force additional to the force induced by the cantilevered contact support. Additionally, a fulcrum is provided for supporting pivotal movement of an armature supporting the cantilevered contacts, and which is combined with the magnetic flux path of the relay.

13 Claims, 5 Drawing Figures

REVERSING RELAY FOR PERMANENT MAGNET DC MOTOR

FIELD OF THE INVENTION

The field of this invention is a switching means movable between a plurality of positions and including a drive means such as a magnetic force producing coil for driving the switching means between contact positions to effect, for example, reverse current connections to an electric motor.

BACKGROUND OF THE INVENTION

The use of relays to reverse current to a device such as a DC motor, and to provide a closed electrical path to a DC motor, are well-known in the prior art. Examples are given in U.S. Pat. Nos. 3,305,718; 2,755,423; 2,446,299; 1,486,386; 2,587,948 and 2,564,256. All of these patents show a reversable relay which operates to switch contacts and reverse the current to a motor while offering a closed path to the motor when the motor is disconnected from the power supply.

Additionally, U.S. Pat. Nos. 2,446,299; 1,736,683; 2,564,246; and 2,587,948 show a relay having a rocking armature. The rocking motion of the armature forces the making and unmaking of switch contacts.

Further shown is that a set of contacts can be used to reverse a motor as shown in U.S. Pat. No. 2,564,246.

Further shown in U.S. Pat. No. 3,305,718 are a group of relay contacts mounted on separate cantilevered supports which are deflected, forcing the contacts into engagement and disengagement. The contacts control the direction of current through a motor and provide a shorting arrangement to effect dynamic braking.

The prior art shown by these patents indicates numerous attempts to provide a type of reversible relay for use with a reversible current motor, which is effective to provide the necessary contact surfaces and contact force to maintain the current as required to the motor, while offering the advantages of a closed path and dynamic breaking when the motor is deenergized. As indicated above, some of these patents show a rocking type armature arranged over two coils separately energized to cause a pivoting motion of the armature and actuation of the relay.

Cantilevered contacts are shown in U.S. Pat. No. 3,305,718. However, while the electrical arrangements are similar to the other prior art disclosures for reversing current as well as for dynamic braking, switch actuation is accomplished through magnetic fields exerting a force directly on the cantilevered contact support arm.

One of the problems in relays, is the generation of sufficient force to maintain contact, especially where a heavy current is supplied through the contacts, as to an electric motor. A second problem is to provide a relay system which is lightweight and which has a minimum of mechanical parts, enhancing reliability and efficiency. A third problem is to construct a relay so the minimum reluctance is encountered in the flux path, and the magnetic force generated on the armature is maximum for the current provided to the coils. Additionally, relays should be of a construction assuring a minimum of light-weight, easily fitted, parts so that the difficulty and cost of assembly and the intensity of magnetic force required is minimized while the contact force is maximized.

SUMMARY OF THE INVENTION

This invention provides a relay capable of switching current to a utilization device such as a permanent magnet DC motor and providing a short circuit when the motor is disconnected from the source to achieve dynamic breaking.

This relay is able to provide maximum contact force to assure minimum contact resistance and while maximizing the magnetic force applied to the relay armature. In addition, the relay is made up of a minimum number of interconnecting parts for easy assembly and for maximizing the efficiency of the relay.

The relay utilizes two coils, each coil having a end adjacent a separate end of a pivoting armature. Separate energization of each coil pivots the armature about a fulcrum and towards the energized coil. In addition, the flux path extends through a core which includes a core portion within the coil, the armature, and the armature fulcrum. In this way, the fulcrum is part of the magnetic core, the magnetic flux path extending from the armature through the fulcrum to the coil core.

Disposed from the plane of the armature are a series of contacts mounted on support arms. The ends of the support arms are attached in a cantilevered manner to the armature. Motion of the armature about the fulcrum in response to energization of the coils, separately forces the cantilevered contacts against opposing adjacent contacts as will be described. Mounted in between the cantilevered contact support arms, are a plurality of force augmenting means. These force augmenting means are shown as springs mounted in a cantilevered fashion, similar to the way the cantilevered support arms are mounted on the armature.

Motion of the armature about the fulcrum, drives at least one cantilevered contact towards an opposing stationary contact deflecting the cantilevered contact arm and forcing the cantilever mounted contact against the opposing stationary contact. In addition, as the cantilevered support arm is deflected, the force augmenting means, the cantilevered spring mounted adjacent the contact support arm, is also deflected, adding its additional force against the cantilevered contact, and augmenting the force of that cantilevered contact arm, driving its contact against the stationary contact.

By a similar manner, a second cantilevered support contact has a second cantilevered spring mounted adjacent to it and provides the same function as the first cantilevered mounted spring.

When the armature is rotated about the fulcrum forcing the first cantilever supported contact towards and against the stationary contact, the first cantilevered support arm is deflected, as is the second cantilevered support arm and the cantilevered spring mounted adjacent the first cantilevered support arm. However, the second cantilevered spring is not deflected as it is merely rotated by the armature and provides no additional force to the contact, nor does it require any additional energy for its displacement, as it is not deflected.

As only one of the contacts mounted on the cantilevered support arms is being displaced to a new stationary contact for a respective direction of armature rotation, only that adjacent cantilevered spring functioning as a force augmenting means must be deflected so it can provide an additional force for that displaced contact against the opposed stationary contact. The other contact is held against its respective opposing contact by the force of its cantilevered contact arm and requires no additional force to maintain its contact. Therefore, it is unnecessary to expend the energy to provide an additional force against this other cantilevered support arm.

As can be seen then, this invention provides a force augmenting means which can be selectively activated to provide a force against a displaced contact when the armature is driven in one direction and which is inactive when the relay armature is driven in the other direction. In this way, a force can be provided selectively, and as necessary in response to the switching condition. Energy need not be expended to provide an additional force in a switching mode where that force is not necessary to maintain a firm contact, but can be selectively used with a contact displaced towards an opposing contact.

Accordingly, it is the object of the invention to provide a reversing type switch providing means for selectively increasing the contact force and minimizing the contact resistance, responsive to switching mode.

Another object of this invention is to provide an armature type relay where the armature pivots about a fulcrum in response to a magnetic force, and the fulcrum is part of the magnetic flux circuit, thereby minimizing the number of parts necessary in the assembly of the relay.

DESCRIPTION OF THE PREFERRED EMBODIMENT

Figure 1:
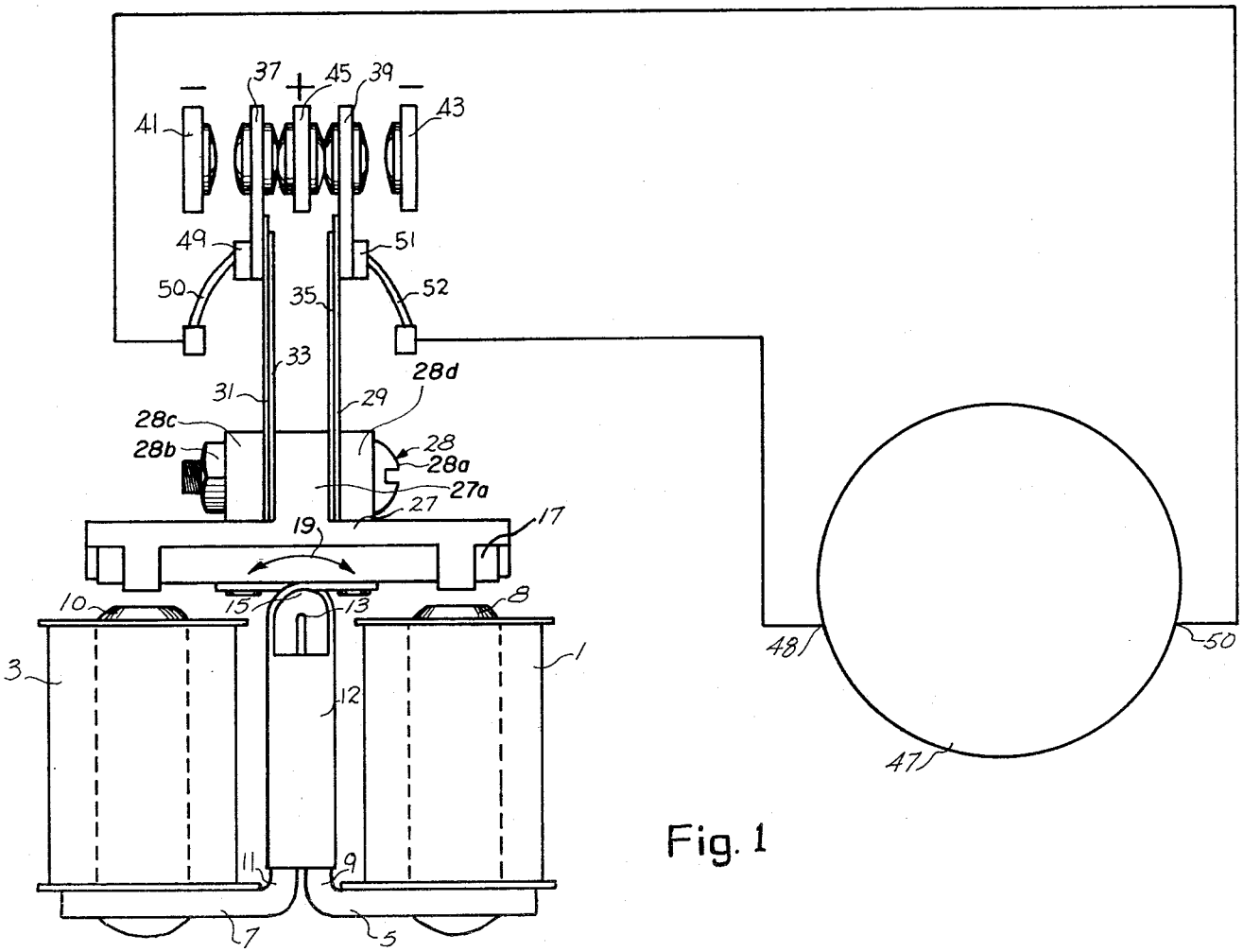
FIG. 1 shows a view of the switching relay in its unenergized position, and wherein a closed path is provided through the relay contacts.

Referring now to FIG. 1, the switching relay in its general form is shown. The relay includes magnetic force producing means shown as two coils, 1 and 3, each coil is mounted on a core serving as a flux path for the magnetic lines of force generated by the coil. Core 5 having a U-shape is shown having a portion through the center of coil 1 and core 7 having a U-shape is shown having a portion passing through coil 3. As shown in FIG. 1 a portion of the respective cores are mounted adjacent each other to provide a common flux path through sections 9 and 11. Spring section 12 as shown, slips over core sections 9 and 11 and provides an "X" spring as will be explained with reference to FIG. 5. Although the core is shown as U-shaped, it should be understood that any other suitable shape may be used without departing from the principles of the invention. The cores are joined at 13 but may also comprise two separate pieces butted together at 13. The core portion 15 forms a support for armature 17. The portion 15 serves as a fulcrum about which the armature may rotate either clockwise or counter-clockwise as shown by the double ended arrow 19. It should be understood that cores 5 and 7 may be a unitary piece and joined at the fulcrum.

Figure 5:
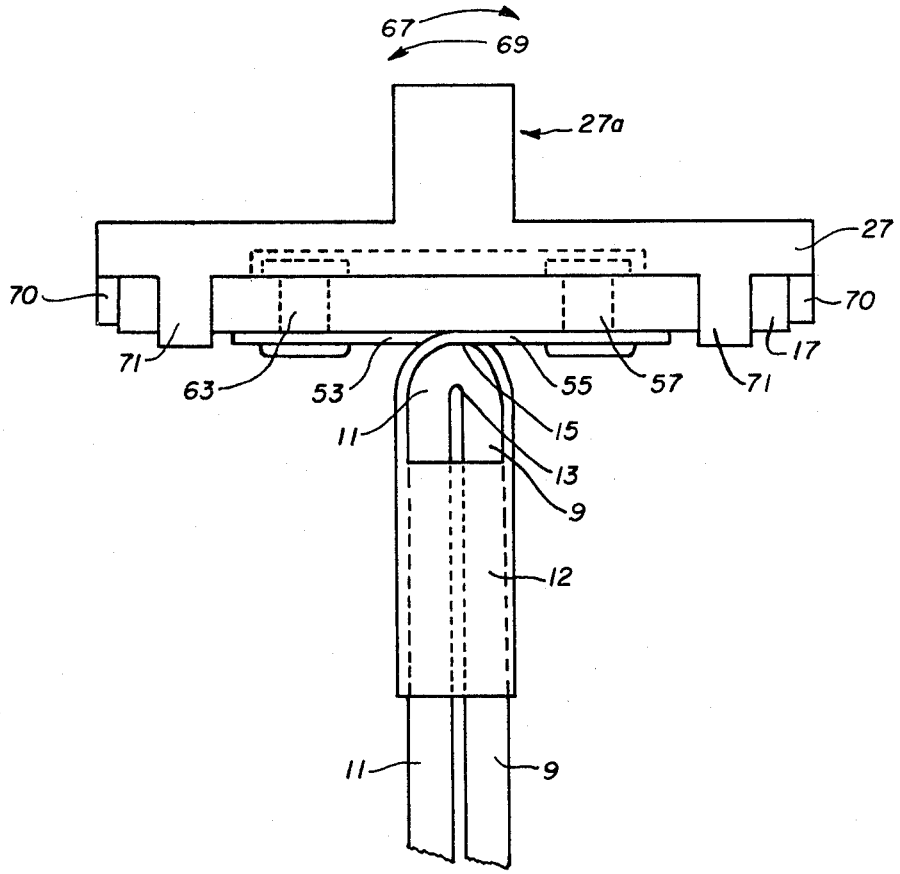
FIG. 5 shows an enlarged partial view of the relay, showing the armature, and the fulcrum and X-spring for holding the armature in equilibrium.

The assembly of the relay may involve merely attaching the armature to spring 12 and sliding the spring 12 over the core sections 9 and 11, as shown in FIG. 5.

Mounted on top of the armature 17 is a support 27 having clamping assembly 28 including bolt **28*a*, nut 28*b*, clamping blocks 28*c* and 28*d*, and projection 27*a* of holder 27. Mounted on the support 27, are a pair of contact support arms 29 and 31. Mounted closely adjacent and along side contact support 31 is force augmenting means 33 and similarly mounted on adjacent contact arm 29 is force augmenting means 35**.

As can be seen, the contact support arms 29 and 31 are mounted in cantilevered fashion on support 27. The means shown as 33 and 35 are spring material mounted in a cantilevered fashion within support 27 and internally of their respective adjacent contact support arms in the direction of the fulcrum 15.

As can be seen from FIG. 1, the means 33 and 35 are adjacent and in contact respective to contact support arms 31 and 29, respectively, although this is not necessary to the practice of the invention. Either force augmenting means, 33 and 35, may be displaced from its adjacent respective contact support arm if deflection of the opposite contact support arm deflects the opposite force augmenting means.

At one end of each of the contact support arms 31 and 29 are contacts 37 and 39 respectively. In contact with contacts 37 and 39 are a set of terminals 49 and 51 respectively, which are each separately connected to the terminals 48, 50 of a utilization device 47 which may be a DC motor 47. Contacts 49 and 51 as shown are attached to their respective contacts 37 and 39 and are connected to device 47 by flexible leads 50 and 52.

Disposed opposite movable contact 37 is a stationary contact 41, and disposed opposite movable contact 39 as a stationary contact 43. As can be seen in FIG. 1, when the relay is unenergized, the armature is held in its equilibrium position by contacts 37 and 39 in contact with stationary contact 45, holding the relay armature 17 in a stationary position through the force exerted on contact support arms 29 and 31. The contact would be in this state where the rotor of motor 47 is dynamatically braked.

As shown, relay contacts 41 and 43 may be connected to the negative side of a DC power supply while contact 45 is connected to the positive side or the connections may be reversed as may be desired in each individual application.

In a neutral position, the utilization device 47 is shorted through its terminals 48 and 50, terminals 49 and 51, the contact support arms 31 and 29, contact terminals 37 and 39 and the stationary contact 45.

The operation of the device is now explained with reference to FIGS. 1, 2 and 3 where the same numerals are used to indicate the same and similarly operating parts.

Figure 2:
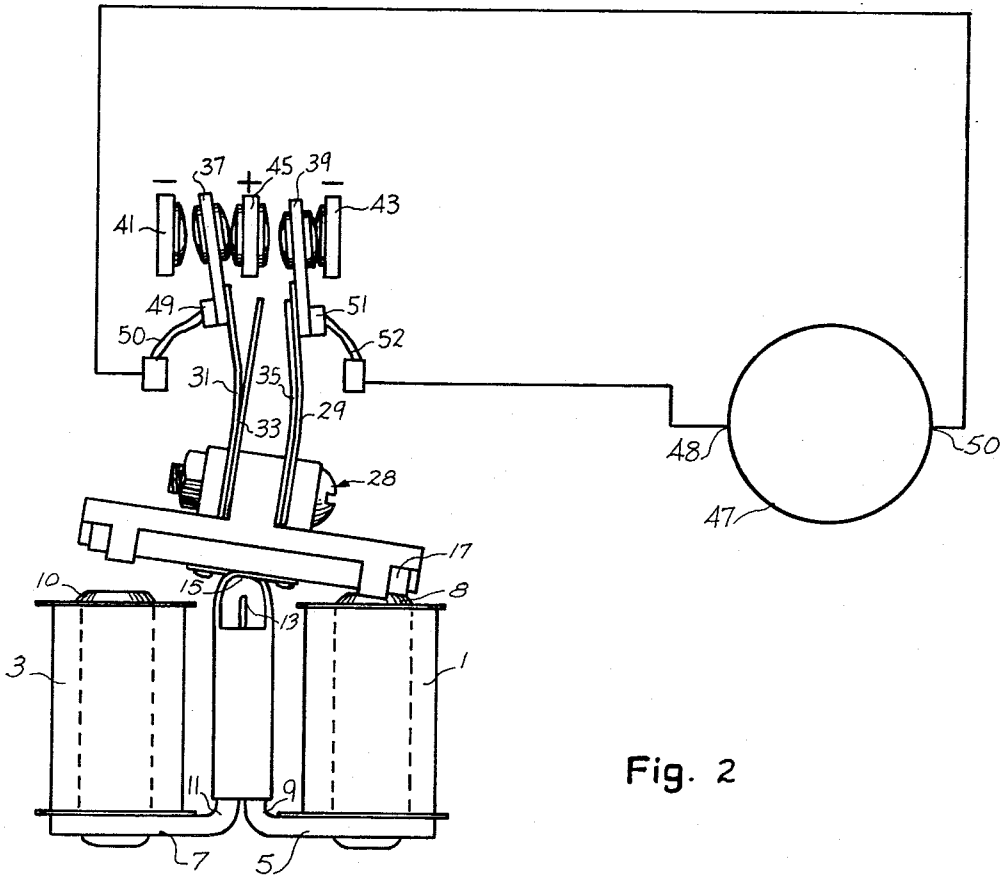
FIG. 2 shows the switching relay of FIG. 1, with the armature rotated about the fulcrum and connecting a utilization device to the power supply causing current to flow in one direction.

As shown in FIG. 2, the armature is rotated about the fulcrum comprising the end 15 of the cores 7 and 5 respectively, under the influence of the magnetic force produced by the coil. The magnetic flux path comprises the core 5 having a section passing through coil 1 and including leg sections 9 and 11 of cores 5 and 7, respectively, the fulcrum 15, and the portion of the armature extending between the fulcrum 15 and the end 8 of the core. When the armature 17 is rotated, contact arms 29 and 31 are accordingly deflected, driving contact 39 away from contact 45 and towards contact stationary 43. Contact 37 is held in its position by stationary contact 45. As contact arm 31 is deflected, it exerts a force on contact 37, forcing it into a stronger contact with contact 45.

When the armature 17 is rotated clockwise about the fulcrum, cantilevered spring 35 is deflected as shown, adding its force to contact arm 29 in the direction of contact 43 and additionally providing a force, augmenting the force of contact arm 29 holding contact 39 against contact 43.

Current is provided from the positive side of the supply through contact 45, contact 37, terminal 49 to terminal 50 and from terminal 48, terminal 51, contact 39 and contact 43.

Figure 3:
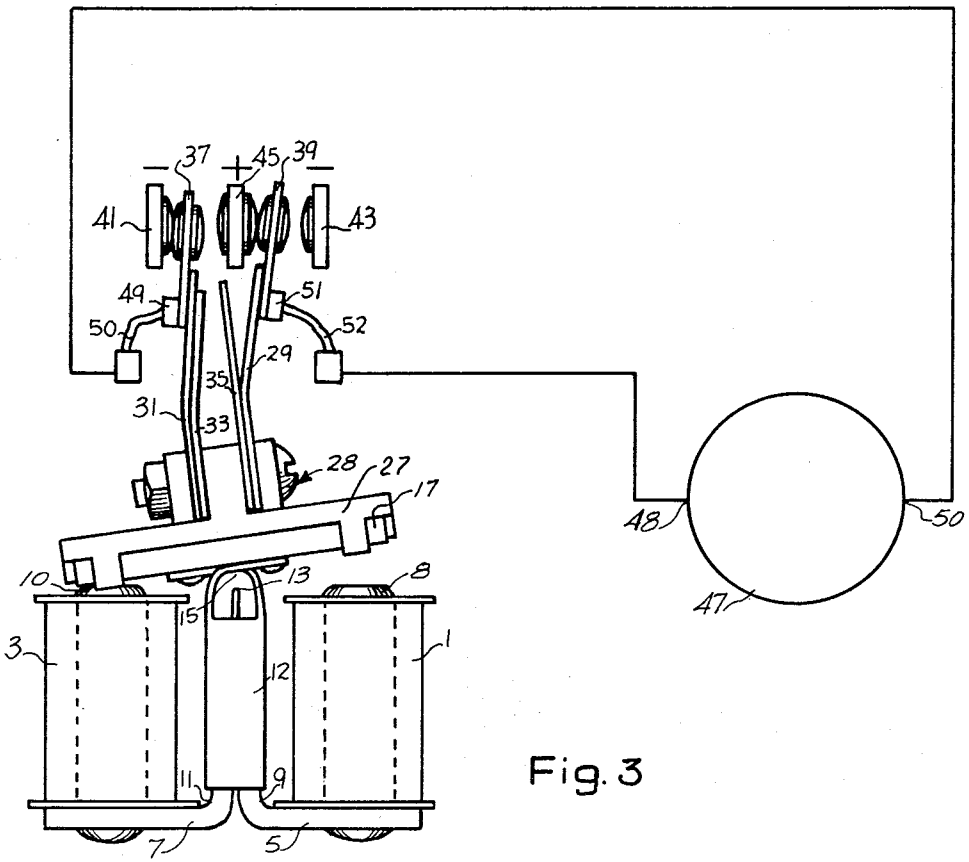
FIG. 3 shows the switching relay of FIGS. 1 and 2 with the armature rotated in the opposite direction about the fulcrum and providing current to the utilization device in an opposite direction.

As shown in FIG. 3 current is reversed to the utilization device 50 by deenergizing coil 1 and energizing coil 3 causing counter-clockwise movement of the armature about the fulcrum 15.

As shown in FIG. 3, terminal 48 is now connected through terminal 51 and contacts 39–45 to the positive side of the supply, while terminal 50 is connected through terminal 49 through contacts 37–41 to the negative side of the supply.

The flux path for the magnetic force produced by coil 3 now comprises the core 7, the leg sections 11 and 9 of cores 7 and 5 respectively, the fulcrum 15, and the armature section between the fulcrum 15 and core end 10.

In this way, the switching relay operates in substantially the same way as shown in FIG. 2, but with the relay armature 17 being rotated in the opposite direction.

As can be seen in FIG. 3 counter-clockwise motion of the armature 17 about the fulcrum causes deflection of the cantilevered support arm 31, the cantilevered support arm 29, and the force augmenting means shown as cantilevered spring 33 adjacent to cantilevered support arm 31. As can be seen, the force augmenting means shown as cantilevered spring 35 is not deflected.

Figure 4:
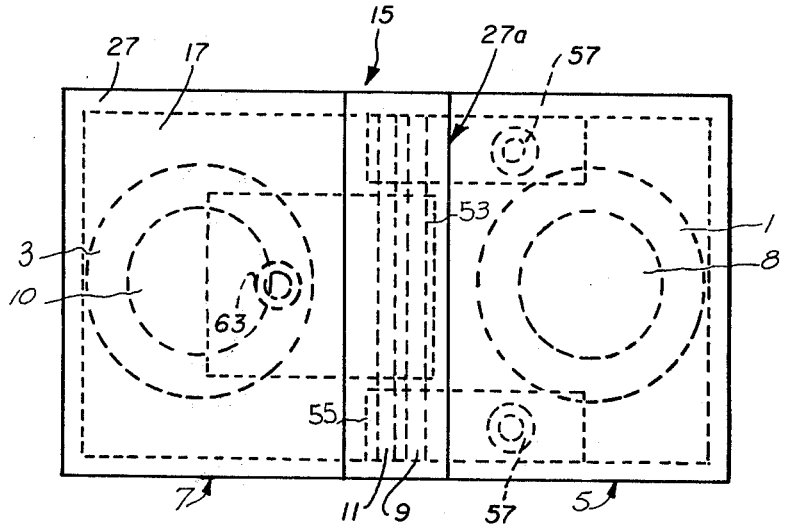
FIG. 4 shows a top view of the relay with the contacts and the contact support removed.

A partial top view of the relay is shown in FIG. 4. The cores 5 and 7 are shown in phantom and may have any suitable shape without deviating from the principles of this invention. The X spring 12 includes portions 53 and 55, shown attached to armature 17, in phantom, by fasteners 57 and 63. As shown, holder 27 overlaps and extends beyond the edges of armature 17.

According to the principles of the invention, a selectively operable means provides an additional force against the mating contacts augmenting the force produced by the cantilevered contact support arms. Moreover, each of the contact support arms has this selectable augmenting force means associated with it. As shown, this means is a cantilevered spring adjacent its respective contact support arm.

The selective force augmenting means is made operable only when necessary to provide its additional force to a movable contact, when it is displaced from one stationary contact to another stationary contact. Where the switching relay is driven to a different position and a contact support arm is not displaced, then the force augmenting means associated with the nondisplaced contact is maintained inactive. No additional force is expended by the driver means to alter the switching position of the relay.

In this case as explained above, the driving force is the magnetic force produced by either coil 1 or coil 3. In operation, as explained before, energizing coil 1 may deflect the armature 17 clockwise, displacing movable contact 39 from stationary contact 45 to stationary contact 43. The additional augmenting force is needed in this case to maintain movable contact 39 against stationary contact 43. Accordingly, the force augmenting means shown as cantilevered spring 35 is deflected by the displacement of movable contact 39, adding its force to the force of contact arm 29.

Movable contact 39 is held at its neutral, dynamic braking position against stationary contact 45 and by the force of its cantilevered contact arm 29. The force augmenting means shown as cantilevered spring 35 is rotated away from contact support arm 29 and does not impart any force to contact support arm 29.

The energy needed to switch the relay from neutral position to that arrangement shown in FIG. 3 is the force necessary to deflect contact support arm 31, contact support arm 29, and forcing means shown as the cantilevered spring 33. The forcing means shown as cantilevered spring 33, in this position, imparts a force to movable contact 37, holding it against stationary contact 41. No additional force is required for contact 39. The force augmenting means shown as cantilevered spring 35 is not deflected and does not provide an additional force nor does it use any energy in this mode.

As can be seen in FIGS. 2 and 3, a force augmenting means is provided for each of the movable contact support arms and the respective contact supports. This force augmenting means is selectively active when its respective movable contact is displaced, driving that movable contact to an opposite stationary contact. The force augmenting means associated with the movable contacts not displaced in a switching mode are held inactive. The energy necessary to alter the switching mode of the system is limited to that necessary for moving the contact support arm contacts and the force augmenting means associated with one respective movable contact.

In this way, no additional energy is required to displace components not necessary for maintaining firm contacts within the switch system.

As further can be seen in FIGS. 2 and 3, the flux path comprises the fulcrum about which the armature rotates. In this way, the need for a separate pivot mechanism is eliminated by combining the fulcrum support with the flux path.

FIG. 5 is a partial side view showing the manner of supporting the armature 17 on the fulcrum 15. An X type spring 12 having sections 53 and 55 is provided, with section 55 being adjacent core section 11 and extending over the fulcrum 15 and being connected to armature 17 by fastener 57. The spring section 53 is adjacent core section 9 and extends over the fulcrum 15 and is fastened to the armature 17 by fastener 63. As can be seen, each spring section extends over the fulcrum and is fastened to a portion of the armature on the opposite side of the fulcrum. Deflection of the armature in the direction shown by arrow 67 is resisted by spring section 55 and deflection of the armature in the direction 69 is resisted by spring section 53. The X spring 12 then maintains armature 17 in its equilibrium position as shown in FIG. 1 until either core 1 or 3 is energized. Also as shown, holder 27 may be frictionally attached to armature 17 by tabs 70 and 71.

It being understood that the principles of this invention may be applied in other embodiments, not disclosed in this application, without departing from the spirit of the invention.

What is claimed is:

1. A switch having first, neutral and second positions, and a set of movable contacts being driven to said first position and to said second position by a driver means operably connected to said set of movable contacts, a first of said set of contacts being displaced by said driver means when said switch is driven by said driver means to its first position and remaining stationary when said switch is driven by said driver means to its second position, and a second one of said contacts remaining stationary when said switch is driven by said driver means to its first position and displaced when said switch is driven by said driver means to its second position, and including selectively operable force augmenting means disposed adjacent to said set of contacts, a first of said force augmenting means disposed adjacent to said first of said set of contacts, operable when said switch is in its first position to provide an augmenting force for the first displaced contact against a first mating contact and inoperable when said switch is driven to its second position, and a second of said force augumenting means disposed adjacent to said second of said set of contacts, inoperable when said switch is driven to its first position and operable to provide an augmenting force for said second displaced contact against a second mating contact when said switch is driven to its second position.

2. The switch of claim 1 including contact support arms, each of said contacts mounted on an end of its respective contact support arm, and the other end of each respective contact support arm being connected to said driver means in a cantilevered manner.

3. The switch of claims 1 or 2 wherein each of said force augmenting means is located adjacent a respective contact support arm.

4. The switch of claim 3, wherein said driving means includes a magnetic force producing means and a magnetic flux path means, said magnetic flux path means including an armature, said cantilevered contact arms and said force augmenting means being mounted on said armature.

said magnetic flux path means including a fulcrum for pivotly supporting said armature and wherein said fulcrum connects the magnetic flux path of the armature to the magnetic force producing means.

5. The switch of claim 4 wherein said magnetic flux path means includes a magnetic core, a portion of said core defining said fulcrum and said armature being pivoted about the said portion of said core.

6. The switch of claim 5 wherein said magnetic force producing means is a coil.

7. The switch of claim 1 wherein each of said force augmenting means is a cantilevered spring, each of said cantilevered springs being mounted on said driver means, and being deflected in one of said first and second positions and being nondeflected in the other of said two positions and in its deflected position augmenting the force of said respective displaced contact against its respective mating contact.

8. The switch of claim 7, wherein each of said contacts is supported on an end of a contact support arm and each of the opposite ends of said contact support arms are mounted in said driver means in a cantilevered fashion and wherein each of said force augmenting means is mounted in said driver means adjacent a respective contact support arm and operable when the respective adjacent contact support arm is displaced to a mating contact by said driver means.

9. The switching means of claim 8 having a neutral position where said driver means is deenergized, each of said contacts being connected to each other through a shorting contact to provide a closed loop path to a utilization device.

10. The switch of claim 10 wherein said switch being in said first position, connecting a supply to cause current to flow in the first direction to said utilization device and connecting said supply in said second position to reverse said current direction to said utilization device.

11. The switch of claim 5 including spring means mounted on said core and attached to said armature for supporting said armature in said neutral position.

12. The switch of claim 11 wherein said spring means is an X spring having at least two sections, two sections being mounted on opposite sides of the fulcrum and each section being attached to the armature and separated from its respective armature connection by the fulcrum.

13. The switch of claim 12 wherein said spring means has a third section attached to said two sections, said third means being mounted on said core.

* * * * *